US008540242B2

(12) United States Patent
Ise

(10) Patent No.: US 8,540,242 B2
(45) Date of Patent: Sep. 24, 2013

(54) IMAGE FORMING APPARATUS, RECORDING MEDIUM DETECTING APPARATUS AND RECORDING MEDIUM DETECTING METHOD

(75) Inventor: Tokihiko Ise, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 259 days.

(21) Appl. No.: 13/089,489

(22) Filed: Apr. 19, 2011

(65) Prior Publication Data

US 2011/0262151 A1 Oct. 27, 2011

Related U.S. Application Data

(60) Provisional application No. 61/326,581, filed on Apr. 21, 2010.

(51) Int. Cl.
*B65H 7/02* (2006.01)

(52) U.S. Cl.
USPC ..... 271/265.04; 271/9.13; 271/265.01

(58) Field of Classification Search
USPC ..... 271/9.13, 258.01, 262, 263, 265.01, 271/265.04, 225, 272, 273
See application file for complete search history.

(56) References Cited

U.S. PATENT DOCUMENTS 6,527,267 B1 * 3/2003 Kuwata et al. ..... 271/9.13
7,198,265 B2 * 4/2007 Chelvayohan et al. ..... 271/110

FOREIGN PATENT DOCUMENTS

JP 63047259 A * 2/1988
JP 01275366 A * 11/1989

* cited by examiner

*Primary Examiner* — Jeremy R Severson
(74) *Attorney, Agent, or Firm* — Patterson & Sheridan, L.L.P.

(57) ABSTRACT

An image forming apparatus according to an embodiment includes an image forming unit which forms an image on a recording medium, and a carrying unit which guides the recording medium to the image forming unit via a first carrying path or a second carrying path. A media sensor is arranged at a part where the first carrying path and the second carrying path merge together, to discriminate the type of the recording medium. The media sensor is movable toward the first carrying path or toward the second carrying path where the recording medium passes.

13 Claims, 4 Drawing Sheets

IMAGE FORMING APPARATUS, RECORDING MEDIUM DETECTING APPARATUS AND RECORDING MEDIUM DETECTING METHOD

CROSS-REFERENCE TO RELATED APPLICATION

This application is based upon and claims the priority of U.S. Provisional Application No. 61/326,581, filed on Apr. 21, 2010, the entire contents of which are incorporated herein by reference.

FIELD

Embodiments described herein relate generally to an image forming apparatus in which a recording medium such as a sheet is carried via plural carrying paths. Embodiments described herein also relate generally to a recording medium detecting apparatus and a recording medium detecting method.

BACKGROUND

Conventionally, an image forming apparatus such as a copy machine or printer can form an image on plural types of recording media with different sizes and thicknesses. As the recording media, paper sheets and OHP sheets and the like are used. In the following description, a sheet is used as an example of the recording media.

A sheet can be supplied to an image forming unit by manual insertion as well as from a paper supply cassette. In the image forming apparatus, an image forming unit including a photoconductive drum is provided. An image is formed on a sheet supplied from a paper supply cassette or a sheet supplied by manual insertion.

By the way, since a sheet is carried to the image forming unit via plural carrying path, a media sensor is installed on each carrying path within the image forming apparatus. Thus, the media sensor discriminates the thickness and type of the sheet passing through each carrying path.

However, there is an inconvenience that the arrangement of the media sensor on each carrying path increases the cost.

DETAILED DESCRIPTION

Figure 1:
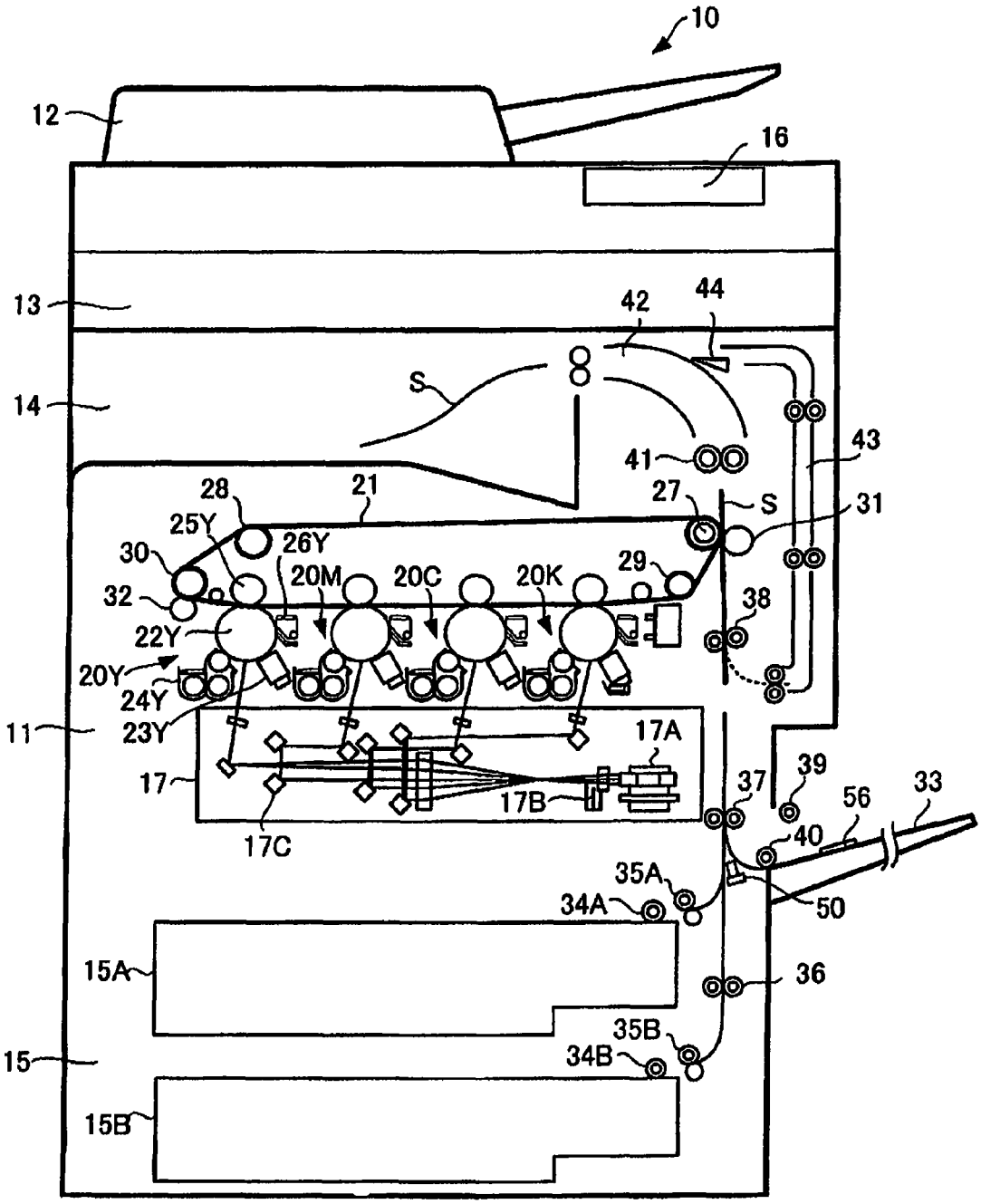
FIG. 1 shows the configuration of an image forming apparatus according to a first embodiment.

In general, according to one embodiment, an image forming apparatus includes:

an image forming unit which forms an image on a recording medium;

a carrying unit which guides the recording medium to the image forming unit via a first carrying path or a second carrying path;

a media sensor which is arranged at apart where the first carrying path and the second carrying path merge together, and which discriminates a type of the recording medium; and a moving mechanism which moves the media sensor toward the first carrying path or toward the second carrying path where the recording medium passes.

Hereinafter, an image forming apparatus according to a first embodiment will be described with reference to the drawings. The same parts in the drawings are denoted by the same reference numerals.

FIG. 1 shows the internal configuration of the image forming apparatus according to the first embodiment. In the following description, an MFP (multi-function peripheral) which is a multi-functional machine is described as an example. However, other image forming apparatuses such as a printer can also be used.

In FIG. 1, an image forming apparatus 10 has an image forming unit 11 at the center of the apparatus. An automatic document feeder (ADF) 12, an image reading unit (scanner) 13 and a paper discharge unit 14 are provided in an upper part of the image forming apparatus 10. A paper supply unit 15 is provided below the image forming unit 11. An operation panel 16 including an operation unit and a display unit is provided in an upper part of the image forming apparatus 10.

The automatic document feeder (ADF) 12 feeds a document to the image reading unit 13. The image reading unit 13 reads the document and generates image data. The image forming unit 11 is formed, for example, by a tandem color laser printer and scans a photoconductive member with a laser beam from a laser exposure device 17 and thus generates an image.

The image forming unit 11 includes image forming sections 20Y, 20M, 20C and 20K for the colors of yellow (Y), magenta (M), cyan (C) and black (K). The image forming sections 20Y, 20M, 20C and 20K are arranged in parallel along the lower side of an intermediate transfer belt 21 as an intermediate transfer medium, from upstream toward downstream.

In the following description, components constituting the image forming sections 20Y, 20M, 20C and 20K are denoted by reference numerals with symbols Y, M, C and K. However, in some cases, the components may be described without the symbols Y, M, C and K.

Since the image forming sections 20Y, 20M, 20C and 20K have the same configuration, the image forming section 20Y will be described as a representative example. The image forming section 20Y has a photoconductive drum 22Y. A charger 23Y, a developing device 24Y, a transfer roller 25Y, a cleaner 26Y and the like are arranged around the photoconductive drum 22Y.

The intermediate transfer belt 21 moves circularly. For example, semi-conducting polyimide is used in view of heat resistance and wear resistance. The intermediate transfer belt 21 is extended over a driving roller 27 and driven rollers 28, 29 and 30. The intermediate transfer belt 21 faces and can contact the photoconductive drum 22Y. At a position on the intermediate transfer belt 21 facing the photoconductive drum 22Y, a primary transfer voltage is applied by the transfer roller 25Y and a toner image on the photoconductive drum 22Y is primary-transferred to the intermediate transfer belt 21.

A secondary transfer roller 31 is arranged facing the driving roller 27 over which the intermediate transfer belt 21 is extended. When a sheet S passes between the driving roller 27 and the secondary transfer roller 31, a secondary transfer voltage is applied by the secondary transfer roller 31 and the toner image on the intermediate transfer belt 21 is secondary-transferred to the sheet S. A belt cleaner 32 is provided near the driven roller 30 on the intermediate transfer belt 21.

An exposure position on the photoconductive drum 22Y is irradiated with a yellow laser beam from the laser exposure device 17 and a latent image is thus formed on the photoconductive drum 22Y. The charger 23Y uniformly charges the entire surface of the photoconductive drum 22Y, for example, to approximately −700 V. The developing device 24Y supplies a two-component developer including toner and carrier of each color to the photoconductive drum 22Y, with a developing roller to which a developing bias of approximately −500 V is applied. The cleaner 26Y removes residual toner on the surface of the photoconductive drum 22Y using a blade.

Meanwhile, the laser exposure device 17 scans the photoconductive drum 22Y in the axial direction with a laser beam emitted from a semiconductor laser element. The laser exposure device 17 includes a polygon mirror 17A, an imaging lens system 17B, a mirror 17C and the like.

The paper supply unit 15 has plural paper supply cassettes 15A and 15B accommodating recording media (sheets or the like) of various sizes. Moreover, the image forming apparatus 10 is provided with a manual insertion tray 33 through which a recording medium is supplied by manual insertion. In the following description, an example of forming an image on a sheet S as a recording medium will be described.

In a path from the paper supply cassettes 15A and 15B to the secondary transfer roller 31, pickup rollers 34A and 34B to take out the sheet S from the paper supply cassettes 15A and 15B, separation rollers 35A and 35B, carrying rollers 36 and 37 and a registration roller 38 are provided. In a path from the manual insertion tray 33 to the registration roller 38, a pickup roller 39 to take out the sheet S and a manual insertion paper supply roller 40 are provided.

Moreover, a fixing device 41 is provided downstream of the secondary transfer roller 31. A paper discharge carrying path 42 is provided from the fixing device 41 to the paper discharge unit 14. A reverse carrying path 43 is further provided. In the reverse carrying path 43, a gate 44 is provided to sort the sheet toward the paper discharge unit 14 or toward the reverse carrying path 43. The reverse carrying path 43 reverses the sheet S and then guides the sheet S in the direction of the secondary transfer roller 31. The reverse carrying path 43 is used in double-side print or the like.

Next, the operation of the image forming apparatus 10 will be briefly described. When image information is inputted from a scanner, personal computer terminal or the like, toner images of yellow (Y), magenta (M), cyan (C) and black (K) are formed by the image forming sections 20Y to 20K and the toner images of magenta (M), cyan (C) and black (K) are multiple-transferred to the same position where the toner image of yellow (Y) is formed, on the intermediate transfer belt 21. Thus, a full-color toner image is provided.

The full-color toner image on the intermediate transfer belt 21 is collectively secondary-transferred onto the sheet S by the secondary transfer roller 31. The sheet S is supplied to the position of the secondary transfer roller 31 from the paper supply cassette 15A or 15B or the manual insertion tray 33. The sheet S to which the toner image is secondary-transferred is sent to the fixing device 41 and the toner image is fixed to the sheet S.

The sheet S to which the toner image is fixed is sorted to the paper discharge unit 14 by the gate 44 when the sheet S has the image on one side. In the case of performing double-side print or multiple prints, the sheet S is sorted toward the reverse carrying path 43 by the gate 44 and is carried again to the secondary transfer roller 31.

Meanwhile, after the secondary transfer is finished, the residual toner on the intermediate transfer belt 21 is cleaned by the belt cleaner 32. The residual toner on the photoconductive drum 22 is removed by the cleaner 26 after the primary transfer of the toner image to the intermediate transfer belt 21, and the photoconductive drum 22 thus becomes available for the next image forming.

The image forming apparatus 10 has plural carrying paths to carry sheets toward the image forming unit 11. The sheet S is supplied, for example, via a carrying path toward the image forming unit 11 from the paper supply cassettes 15A and 15B, a carrying path toward the image forming unit 11 from the manual insertion tray 33, or a carrying path toward the image forming unit 11 from the reverse carrying path 43. Since sheets with different sizes and thicknesses are supplied from each carrying path, the type of the sheet (for example, thickness) is detected by a media sensor.

The media sensor is expensive. Therefore, arranging the media sensor in each carrying path raises the cost and also increases the installation space.

Thus, in the first embodiment, an image forming apparatus is provided in which sheets passing through plural carrying paths are detected by a common media sensor. The media sensor is arranged at a merging point where the plural carrying paths merge together. The media sensor is also made movable in the direction of each carrying path. The position of the media sensor is controlled every time the supply source of the supplied sheet changes.

Hereinafter, the media sensor and a moving mechanism of the media sensor will be described.

Figure 2A:
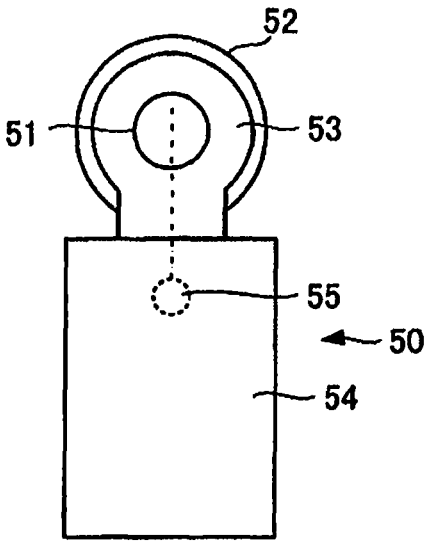
FIG. 2A and FIG. 2B are explanatory views showing the configuration and operation of a media sensor in the first embodiment.
Figure 2B:
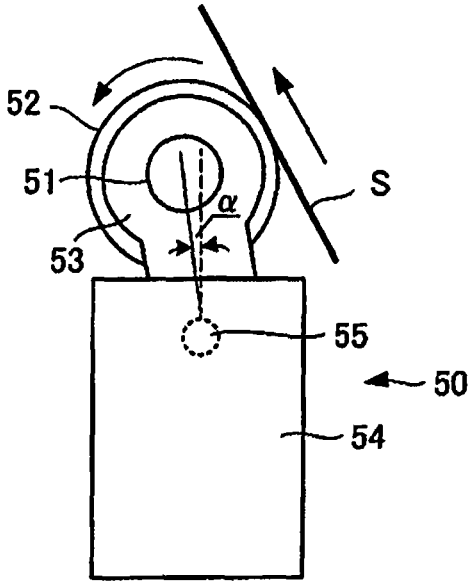

FIG. 2A and FIG. 2B are explanatory views showing a media sensor 50 and the operation of the media sensor. As shown in FIG. 2A, the media sensor 50 has a roller 52 provided on the outer circumference of a bearing 51, and a supporting part 53 supporting the roller 52. The supporting part 53 is rotatable about a fulcrum 55 provided in a body part 54 of the sensor. A magnet is provided at the base of the supporting part 53. A magnetic sensor is provided in the body part 54.

As shown in FIG. 2B, the roller 52 of the media sensor 50 can contact the sheet. When sheet S is carried in contact with the roller 52, the roller 52 rotates around the bearing 51 because of the friction with the sheet S. When the thickness of the sheet S is changed, the supporting part 53 rotates about the fulcrum 55 as indicated by angle $\alpha$. As the angle of inclination of the supporting part 53 changes, the magnetic force changes. The magnetic sensor in the body part 54 detects magnetic resistance due to the change in the magnetic force and detects the thickness of the sheet S.

Figure 3:
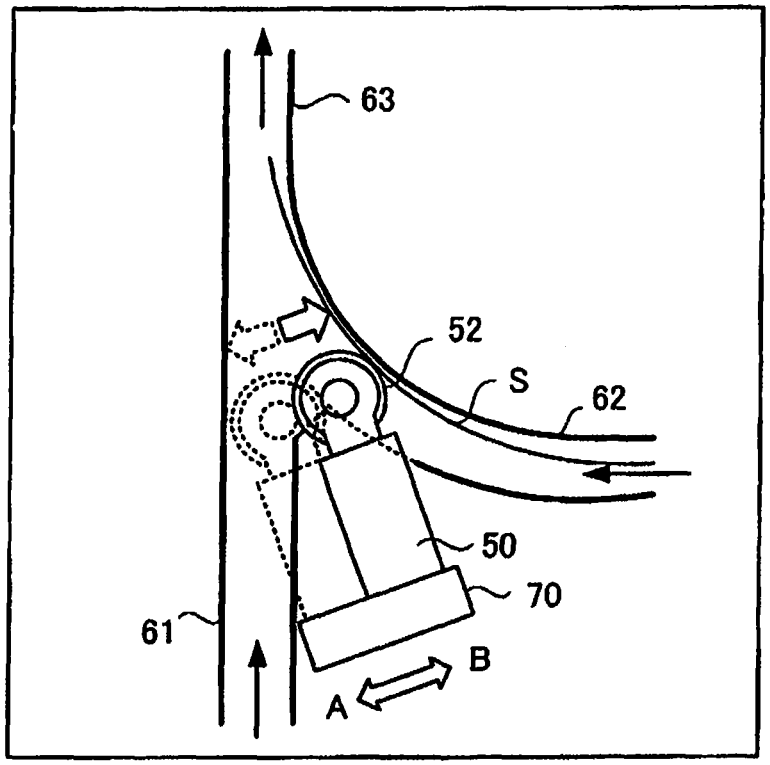
FIG. 3 shows the arrangement of the media sensor and the configuration of a moving mechanism of the media sensor.

FIG. 3 shows the position of arrangement of the media sensor 50 and the configuration of the moving mechanism. In the example of FIG. 3, the media sensor 50 is arranged at a merging point where a sheet carrying path 61 toward the image forming unit 11 from the paper supply cassette 15A (or 15B) and a sheet carrying path 62 toward the image forming unit 11 from the manual insertion tray 33 merge together.

Hereinafter, the sheet carrying path from the paper supply cassette 15A (or 15B) is called a first carrying path 61. The sheet carrying path from the manual insertion tray 33 is called a second carrying path 62. The sheet carrying path toward the secondary transfer roller 31 in the image forming unit 11 after the merging point is called a third carrying path 63. Besides, the first carrying path 61, the second carrying path 62 and the third carrying path 63 configure the carrying unit.

A moving mechanism 70 to move the media sensor 50 is provided. The moving mechanism 70 moves the media sensor 50 toward the first carrying path 61 (in the direction of arrow A) or toward the second carrying path 62 (in the direction of arrow B) according to the carrying of the sheet S.

Figure 4:
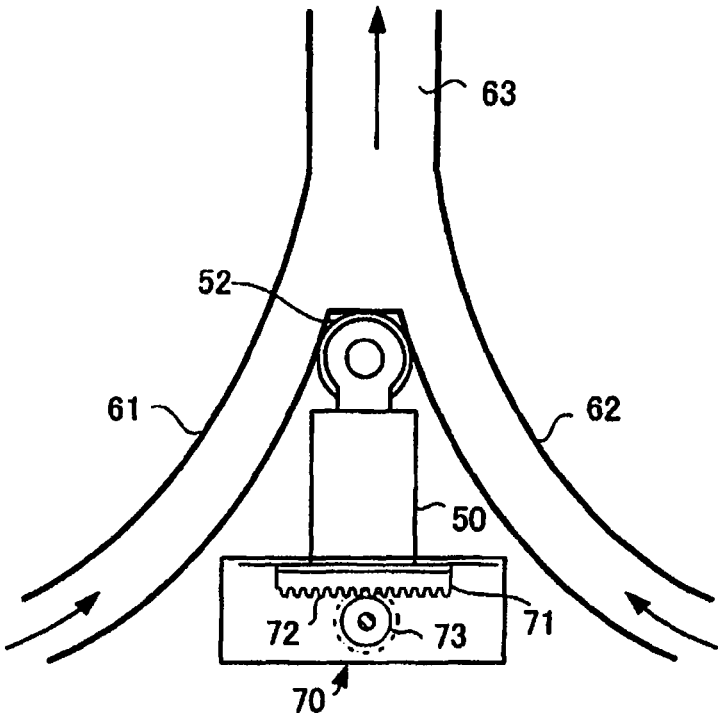
FIG. 4 shows an example of the moving mechanism.

FIG. 4 shows the configuration of an example of the moving mechanism 70 of the media sensor 50. In FIG. 4, it is assumed that the media sensor 50 moves in left-right directions, so that the movement of the media sensor 50 by the moving mechanism 70 can be easy to understand. The description also assumes that the first carrying path 61 and the second carrying path 62 are symmetrical about the third carrying path 63.

The moving mechanism 70 has a moving member 71 supporting the media sensor 50. A rack 72 is formed on the moving member 71. A gear 73 is provided to mesh with the rack 72. The gear 73 is driven by a motor. As the motor rotates the gear 73 forward and backward, the moving member 71 can move in the direction of arrow A or B.

Figure 5:
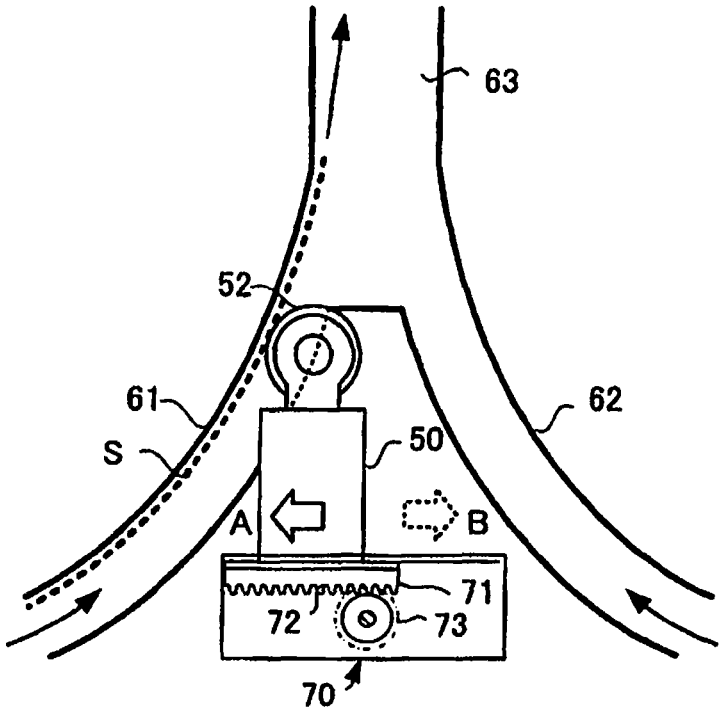
FIG. 5 is an explanatory view showing the operation of the moving mechanism.

As shown in FIG. 5, when the sheet S passes through the first carrying path 61, the moving mechanism 70 moves the media sensor 50 in the direction of the first carrying path 61 (the direction of arrow A) and presses the roller 52 against the sheet S. Therefore, the media sensor 50 can detect the thickness of the sheet S passing through the first carrying path 61.

When the sheet S passes through the second carrying path 62, the moving mechanism 70 moves the media sensor 50 in the direction of the second carrying path 62 (the direction of arrow B) and presses the roller 52 against the sheet S. Therefore, the media sensor 50 can detect the thickness of the sheet S passing through the second carrying path 62.

Usually, there are many cases where the image forming apparatus 10 forms an image on the sheet S carried form the paper supply cassettes 15. Therefore, the media sensor 50 may be situated usually toward the first carrying path 61 and may be moved toward the second carrying path 62 when the sheet S is supplied by manual insertion.

As for the timing of detecting the thickness of the sheet S, the thickness is detected in response to an operation on the operation panel 16. For example, when the user operates the operation panel 16 to set the sheet size and the number of sheets and then presses the copy button, the media sensor 50 is moved in the direction of the first carrying path 61. Then, every time sheets are sequentially carried, the thickness of each sheet is detected.

A sheet sensor 56 is provided on the manual insertion tray 33 (FIG. 1). When the sheet S is placed on the manual insertion tray 33, the sensor 56 detects the sheet S and the moving mechanism 70 moves the media sensor 50 in the direction of the second carrying path 62. Then, as the user operates the operation panel 16 to set the sheet size and the number of sheets and then presses the copy button, the media sensor 50 detects the thickness of each sheet carried sequentially via the second carrying path 62.

Figure 6:
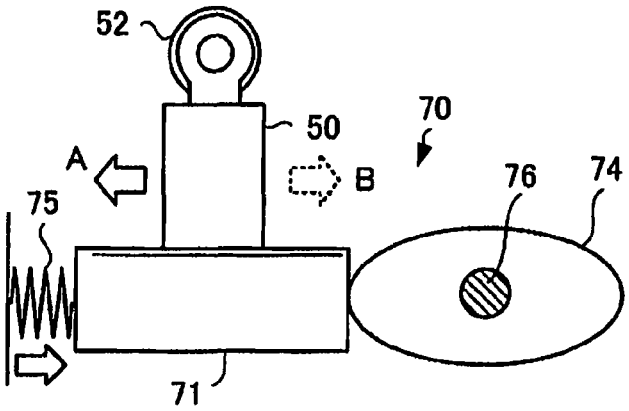
FIG. 6 shows another example of the moving mechanism.

FIG. 6 shows the configuration of another example of the moving mechanism 70. In FIG. 6, the moving member 71 supports the media sensor 50. A cam 74 is in contact with the moving member 71. A spring 75 energizes the moving member 71 so that the moving member 71 is constantly in contact with the cam 74. The cam 74 is, for example, an elliptic eccentric cam and rotates about a shaft 76. A motor rotates the shaft 76, causing the moving member 71 to move in the direction of arrow A or arrow B.

The moving member 71 is not limited to the above example and various modifications can be employed.

Figure 7:
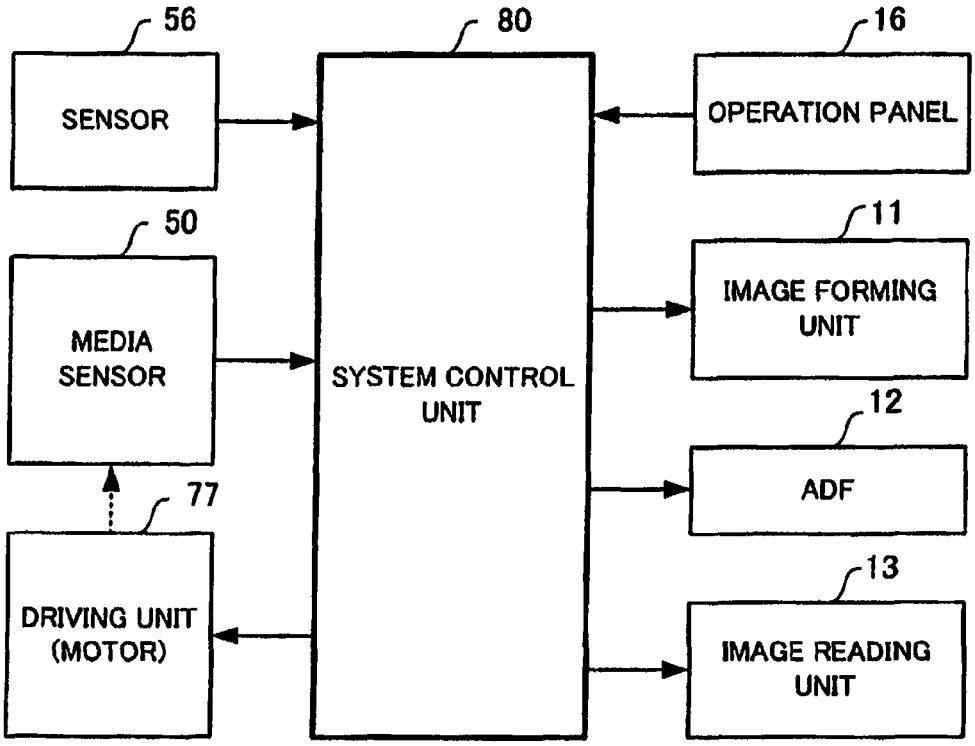
FIG. 7 is a block diagram showing a control system of the image forming apparatus.

FIG. 7 is a block diagram showing a control system of the image forming apparatus according to the embodiment. In FIG. 7, a system control unit 80 includes a CPU and ROM, and controls the image forming unit 11, the ADF 12, the image reading unit 13 and the like of the image forming apparatus 10 according to a control program stored in the ROM.

The operation panel 16 is connected to the system control unit 80. As the user operates the operation panel 16, the system control unit 80 controls the image forming unit 11 and the image reading unit 13, executing operations such as print, copy, and scan.

The system control unit 80 is also supplied with the result of detection from the media sensor 50. The system control unit 80 controls the image forming unit 11 according to the thickness of the sheet detected by the media sensor 50 and thus adjusts the image forming state. For example, when the sheet S is thick, the amount of toner transferred to the sheet S is increased or the fixing temperature of the fixing device 41 is set to a relatively high temperature. Meanwhile, when the sheet S is thin, the amount of toner transferred to the sheet S is reduced or the fixing temperature of the fixing device 41 is set to a relatively low temperature.

The result of detection from the sensor 56 provided on the manual insertion tray 33 is also inputted to the system control unit 80. The system control unit 80 drives a driving unit 77 according to the result of detection from the sensor 56. The driving unit 77 is provided with a motor. The motor rotates to rotate the gear 73 or the cam 74 of the moving mechanism 70.

For example, when a sheet is set on the manual insertion tray 33, the system control unit 80 determines that the apparatus is in the manual insertion mode, and the media sensor 50 is moved in the direction of the second carrying path 62. When no sheets are set on the manual insertion tray 33, the system control unit 80 determines that the apparatus is in the normal mode, and the media sensor 50 is moved in the direction of the first carrying path 61.

In the above example, the media sensor 50 is arranged on the sheet carrying path from the paper supply cassettes 15 or the manual insertion tray 33. However, the media sensor 50 may also be provided at a merging point between the carrying path toward the registration roller 38 from the paper supply cassettes 15 and the carrying path toward the registration roller 38 from the reverse carrying path 43 shown in FIG. 1.

The reverse carrying path 43 is used for double-side print. The thickness of the sheet varies depending on the amount of toner adhering to both sides of the sheet. Therefore, for example, the amount of the adhering toner transferred to the sheet S can be controlled according to the result of detection from the media sensor 50.

Sheets can also be supplied from an external large-capacity paper supply tray in addition to the paper supply cassettes 15. Therefore, the media sensor 50 may be arranged at a part where the sheet carrying path from the paper supply cassettes 15 and the sheet carrying path from the large-capacity paper supply tray merge together, and the media sensor 50 may detect the thickness of the sheet in each carrying path.

In the embodiment, the technique which is applied to the image forming apparatus is described. However, the technique may also be applied to a recording medium detecting apparatus that does not include the image forming unit 11 but includes the parts downstream of the paper supply unit 15 in terms of the sheet carrying direction and up to the third carrying path 63, as an independent unit.

According to such embodiments, the moving mechanism moves the media sensor 50, enabling common use of the media sensor 50 in plural carrying paths. Therefore, the installation space for the media sensor 50 need not be increased and the rise in the cost can be restrained.

Various modifications can be implemented without being limited to the embodiments. For example, an image can be formed on other recording media than the sheet S, such as OHP sheets. Therefore, the difference in thickness between a paper sheet and an OHP sheet may be discriminate and the image forming state may be controlled. The media sensor 50 may detect light transmittance to discriminate the type of paper, other than detecting the thickness of the sheet S.

While certain embodiments have been described, these embodiments have been presented by way of example only, and are not intended to limit the scope of the invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming unit which forms an image on a recording medium;

a carrying unit which conveys the recording medium to the image forming unit via a first carrying path or a second carrying path;

a media sensor which is arranged at a part where the first carrying path and the second carrying path merge together, and which identifies a type of the recording medium; and a moving mechanism which includes a movable member that supports the media sensor and a motor that drives the movable member, and which moves the media sensor toward the first carrying path or toward the second carrying path, depending on which of the first and second carrying paths the recording medium is conveyed through.

2. The apparatus of claim 1, wherein in the moving mechanism, a rack is disposed on the movable member and a gear meshing with the rack is provided, and the motor rotates the gear to move the movable member.

3. The apparatus of claim 1, wherein the moving mechanism includes an eccentric cam constantly in contact with the movable member, and the motor rotates the eccentric cam to move the movable member.

4. The apparatus of claim 1, wherein the media sensor is moved in response to a user's operation and identifies the type of the recording medium when the recording medium is conveyed through the first carrying path or the second carrying path.

5. The apparatus of claim 1, wherein the media sensor detects a thickness of the recording medium, and the image forming unit adjusts an amount of toner transferred to the recording medium according to the thickness of the recording medium detected by the media sensor.

6. A recording medium detecting apparatus comprising:

a carrying unit which conveys guides a recording medium via a first carrying path or a second carrying path;

a media sensor which is arranged at a part where the first carrying path and the second carrying path merge together, and which identifies a type of the recording medium; and a moving mechanism which includes a movable member that supports the media sensor and a motor that drives the movable member, and which moves the media sensor toward the first carrying path or toward the second carrying path, depending on which of the first and second carrying paths the recording medium is conveyed through.

7. The apparatus of claim 6, wherein in the moving mechanism, a rack is disposed on the movable member and a gear meshing with the rack is provided, and the motor rotates the gear to move the movable member.

8. The apparatus of claim 6, wherein the moving mechanism includes an eccentric cam constantly in contact with the movable member, and the motor rotates the eccentric cam to move the movable member.

9. The apparatus of claim 6, wherein the media sensor detects a thickness of the recording medium.

10. A recording medium detecting method comprising:

moving a media sensor arranged at a part where a first carrying path and a second carrying path merge together, toward the first carrying path or toward the second carrying path through which a recording medium passes, depending on which of the first and second carrying paths the recording medium passes through;

conveying the recording medium via the first carrying path or the second carrying path; and identifying a type of the recording medium with the media sensor.

11. The method of claim 10, wherein the media sensor is positioned toward the first carrying path in a normal mode and moves toward the second carrying path when the recording medium passes through the second carrying path.

12. The method of claim 10, wherein moving the media sensor comprises driving a movable member with a motor, the movable member supporting the media sensor.

13. The method of claim 10, wherein the media sensor is moved in response to a user's operation and identifies the type of the recording medium when the recording medium passes through the first carrying path or the second carrying path.

* * * * *